US005947832A

United States Patent [19]

Gagne

[11] Patent Number: 5,947,832

[45] Date of Patent: Sep. 7, 1999

[54] GOLF TRAINING AID

[76] Inventor: Raymond S. Gagne, 23707 Welch House W., Katy, Tex. 77493

[21] Appl. No.: 09/189,561

[22] Filed: Nov. 11, 1998

Related U.S. Application Data

[63] Continuation-in-part of application No. 09/022,357, Feb. 12, 1998, abandoned.

[51] Int. Cl.[6] ..... A63B 69/36

[52] U.S. Cl. ..... 473/217; 473/272; 473/273; 473/271; 473/252

[58] Field of Search ..... 473/217, 218, 473/272, 273, 270, 271; 434/252

[56] References Cited

U.S. PATENT DOCUMENTS

| | | | |
|---|---|---|---|
| 2,482,930 | 9/1949 | Norwood | 473/217 X |
| 3,708,174 | 1/1973 | Kamarauskas | 473/273 |
| 5,150,903 | 9/1992 | Percic | 473/217 |

*Primary Examiner*—George J. Marlo

[57] ABSTRACT

A golf training aid for teaching an individual correct ball positioning when in a golfer's stance. The inventive device includes a pliable U-shaped member dimensioned for securement to a heel of a golfer's shoe. An aiming rod extends from the U-shaped member.

9 Claims, 2 Drawing Sheets

GOLF TRAINING AID

This application is a continuation-in-part of my prior utility patent application Ser. No. 09/022,357, filed Feb. 12, 1998, now abandoned.

BACKGROUND OF THE INVENTION

1. Field of the Invention

The present invention relates to golf stance devices and more particularly pertains to a new golf training aid for teaching an individual correct ball positioning when in a golfer's stance.

2. Description of the Prior Art

The use of golf stance devices is known in the prior art. More specifically, golf stance devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf stance devices include U.S. Pat. No. 5,322,288 to Amis; U.S. Pat. No. 4,784,393 to Williams et al.; U.S. Pat. No. Des. 311,568 to Jacques; U.S. Pat. No. 5,335,915 to Baudier; U.S. Pat. No. 5,388,833 to Goyen, Jr.; U.S. Pat. No. 5,435,727 to Dobson; U.S. Pat. No. 2,482,930 to Norwood; and U.S. Pat. No. 3,708,174 to Kamarauskas.

While these devices fulfill their respective, particular objectives and requirements, the aforementioned patents do not disclose a new golf training aid. The inventive device includes a pliable U-shaped member dimensioned for securement to a heel of a golfer's shoe. An aiming rod extends from the U-shaped member.

In these respects, the golf training aid according to the present invention substantially departs from the conventional concepts and designs of the prior art, and in so doing provides an apparatus primarily developed for the purpose of teaching an individual correct ball positioning when in a golfer's stance.

SUMMARY OF THE INVENTION

In view of the foregoing disadvantages inherent in the known types of golf stance devices now present in the prior art, the present invention provides a new golf training aid construction wherein the same can be utilized for teaching an individual correct ball positioning when in a golfer's stance.

The general purpose of the present invention, which will be described subsequently in greater detail, is to provide a new golf training aid apparatus and method which has many of the advantages of the golf stance devices mentioned heretofore and many novel features that result in a new golf training aid which is not anticipated, rendered obvious, suggested, or even implied by any of the prior art golf stance devices, either alone or in any combination thereof.

To attain this, the present invention generally comprises a pliable U-shaped member dimensioned for securement to a heel of a golfer's shoe. The U-shaped member has a ball-and-socket joint extending outwardly from one side thereof. An aiming rod is pivotally coupled to the U-shaped member by the ball-and-socket joint. The aiming rod includes an outer member and an inner telescoping member. The inner telescoping member is slidably disposed within the outer member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf training aid apparatus and method which has many of the advantages of the golf stance devices mentioned heretofore and many novel features that result in a new golf training aid which is not anticipated, rendered obvious, suggested, or even implied by any of the prior art golf stance devices, either alone or in any combination thereof.

It is another object of the present invention to provide a new golf training aid which may be easily and efficiently manufactured and marketed.

It is a further object of the present invention to provide a new golf training aid which is of a durable and reliable construction.

An even further object of the present invention is to provide a new golf training aid which is susceptible of a low cost of manufacture with regard to both materials and labor, and which accordingly is then susceptible of low prices of sale to the consuming public, thereby making such golf training aid economically available to the buying public.

Still yet another object of the present invention is to provide a new golf training aid which provides in the apparatuses and methods of the prior art some of the advantages thereof, while simultaneously overcoming some of the disadvantages normally associated therewith.

Still another object of the present invention is to provide a new golf training aid for teaching an individual correct ball positioning when in a golfer's stance.

Yet another object of the present invention is to provide a new golf training aid which includes a pliable U-shaped member dimensioned for securement to a heel of a golfer's shoe. An aiming rod extends from the U-shaped member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
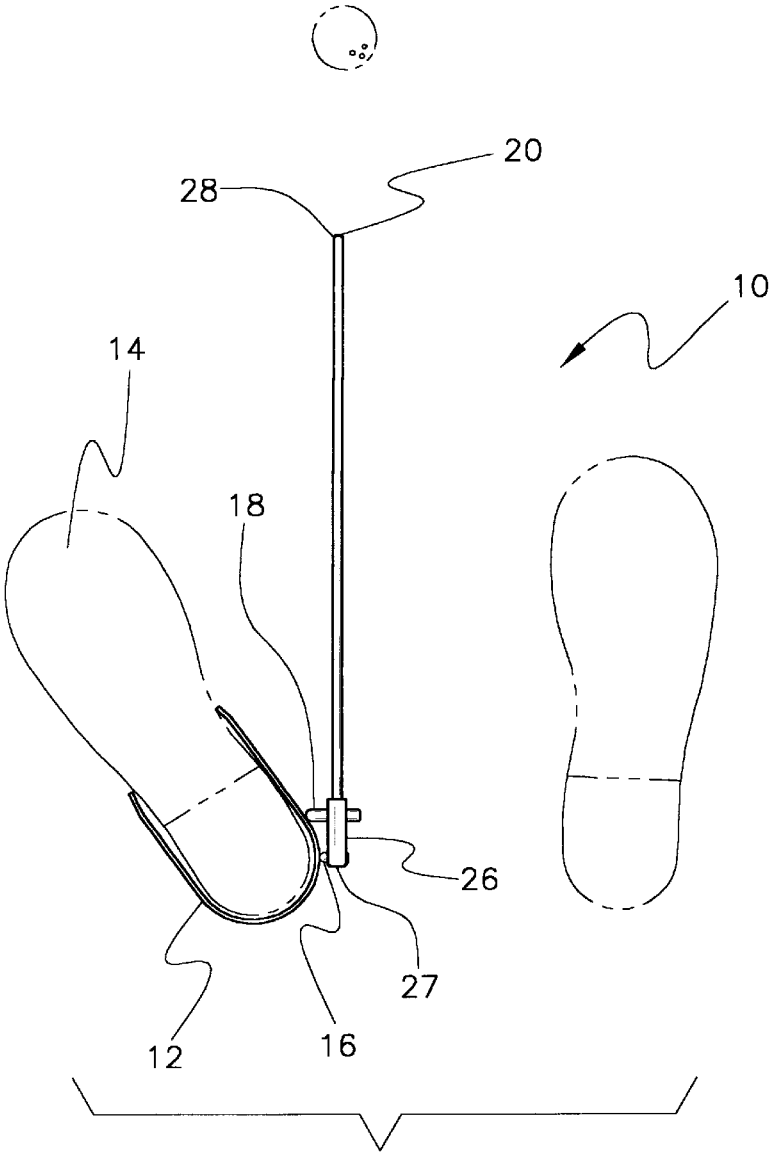
FIG. 1 is a plan view of a new golf training aid according to the present invention.
Figure 2:
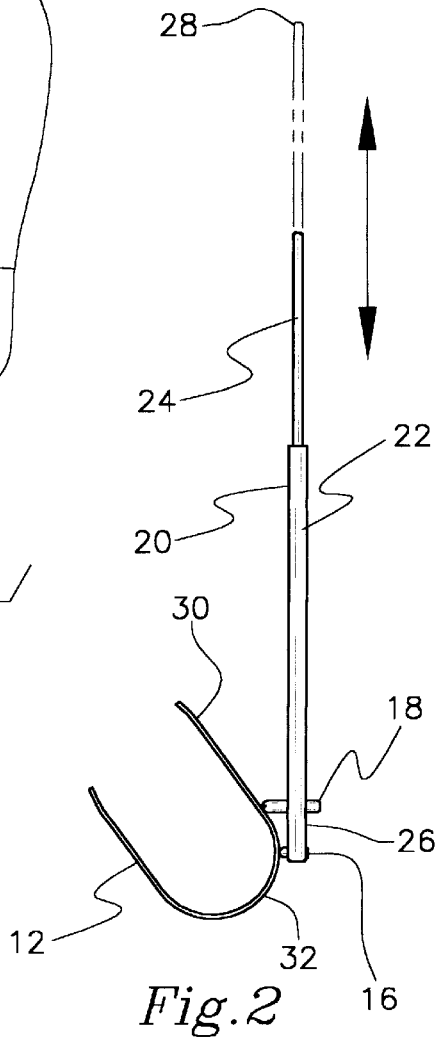
FIG. 2 is a plan view of the present invention illustrated in an extended orientation.

With reference now to the drawings, and in particular to FIGS. 1 through 5 thereof, a new golf training aid embodying the principles and concepts of the present invention and generally designated by the reference numeral 10 will be described.

As best illustrated in FIGS. 1 through 5, the golf training aid 10 generally comprises a U-shaped member 12 dimensioned to be secured to a heel of a golfer's shoe 14. An elongate aiming rod 20 extends from the U-shaped member 12 and has opposite first and second ends 28 and a longitudinal axis that extends between the ends 27, 28.

More specifically, as shown in FIG. 1, the U-shaped member 12 is pliable and is dimensioned for securement to a heel of a golfer's shoe 14. The shoe 14 is inserted in the channel between the straight portions 30 of the U-shaped member 12 and slid back until it abuts the curved portion 32 of the U-shaped member 12. The U-shaped member 12 is held in place on the shoe 14 by clamping action. The U-shaped member 12 may be provided in a variety of sizes to accommodate larger or smaller feet, or may be constructed such that one sized U-shape member clamps onto many sizes of shoes 14.

The aiming rod 20 may or may not telescope. Preferably, the aiming rod 20 includes an outer member 22 and an inner telescoping member 24. The inner telescoping member 24 is slidably disposed within the outer member 22. Ideally, the length of the aiming rod 20 between the first and second ends 27, 28 is adjustable to a length of between about eight inches and thirty inches to permit the same device to be used by both a multiplicity of golfers, including adult golfers and children golfers, without each having to have their own.

Figure 4:
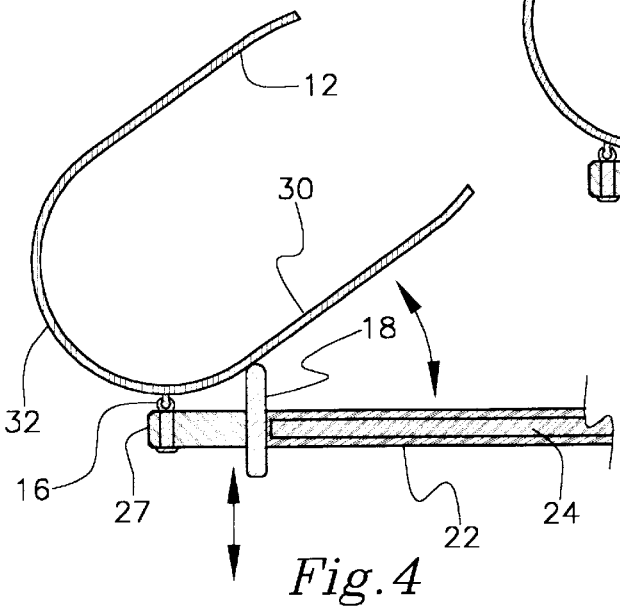
FIG. 4 is a cross-sectional view of the present invention as taken along line 4—4 of FIG. 3 showing the aiming rod in a position towards the distant position.
Figure 5:
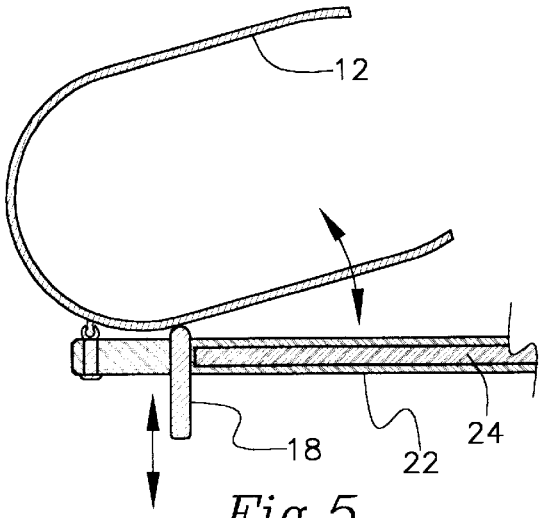
FIG. 5 is a cross-sectional view of the present invention showing the aiming rod in a position towards the proximate position.

Preferably, the U-shaped member 12 has a ball-and-socket joint 16 extending from it that pivotally couples the aiming rod 20 to the U-shaped member 12. As illustrated in FIGS. 4 and 5, the aiming rod 20 is pivotable with respect to the U-shaped member 12 between a proximate position and a distant position for pointing the second end 28 of the aiming rod 20 to a preferred ball position relative to the shoe 14 of the golfer. The aiming rod 20 is positioned substantially parallel an adjacent straight portion 30 of the U-shaped member 12 when in the proximate position. The aiming rod 20 is positioned at an angle up to about ninety degrees from the adjacent straight portion 30 of the U-shaped member 12 when in the distant position.

Ideally, the first end 26 of the aiming rod 20 has a pivot pin 18 slidably coupled to it. The pivot pin 18 abuts the U-shaped member 12 to save a favorite position of the U-shaped member 12 between the proximate and distant positions as well as to permit repeated positioning of the aiming rod 20 at a predetermined position between the proximate and distant positions, especially if the aiming rod 20 is being moved between a raised position and a lowered position, as discussed more fully below. Most ideally, the end of the pivot pin 18 that abuts the U-shaped member 12 is rounded to permit easier sliding of the pivot pin 18 along the U-shaped member 12 as the aiming rod 20 moves between the proximate and distant positions.

Figure 3:
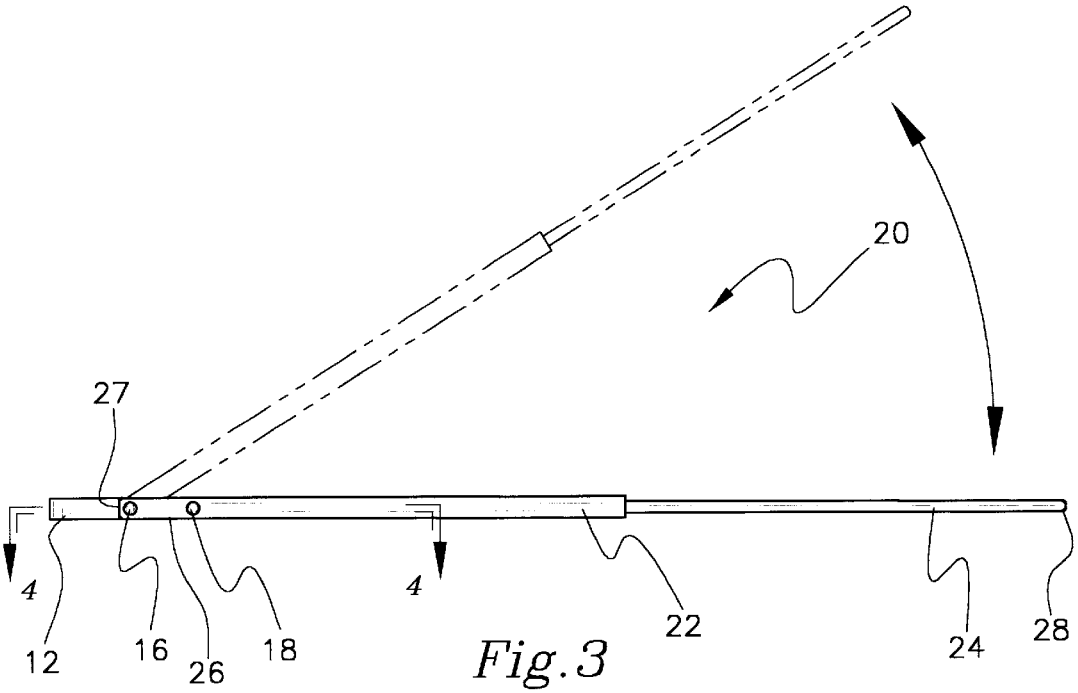
FIG. 3 is a side elevation view of the present invention illustrated in an extended and raised orientation.

Also preferably, as shown in FIG. 3, the aiming rod 20 is pivotable with respect to the U-shaped member 12 between a lowered position and a raised position to permit normal walking by a person wearing the golfer's shoe 14. The aiming rod 20 is positioned substantially in a plane defined by the U-shaped member 12 when in the lowered position. The aiming rod 20 is positioned substantially perpendicular to the plane defined by the U-shaped member 12 and adjacent a lower leg of a golfer when in the raised position.

In use, the present invention is a golf training aid 10 intended to teach an individual the correct ball position in a golfer's stance. The aiming rod 20 would be hinged to fold up against the leg so that a golfer could walk between shots with the device 10 attached to the shoe 14. The aiming rod 20 would telescope from eight to thirty inches in length. This device 10 would train a golfer to maintain a consistent ball position in relation to his body and his foot positioning by providing a visual aid by addressing the ball. The aiming rod 20 would-serve as an extension of the rear of the golfer's leading foot. Once in his stance, the golfer could swing this rod down to align the ball consistently every time. The aiming rod 20 could be adjusted in length for the correct distance from the body and adjusted using the pin 18 for the correct alignment with the feet. It would provide a tool for aligning the ball exactly the same way for every shot with the same club.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf training aid for teaching an individual correct ball positioning when in a golfer's stance comprising, in combination:

a U-shaped member dimensioned for securement to a heel of a golfer's shoe; and an elongate aiming rod extending from the U-shaped member and having opposite first and second ends and a longitudinal axis extending between the ends.

2. The golf training aid of claim 1, wherein the aiming rod includes an outer member and an inner telescoping member, the inner telescoping member being slidably disposed within the outer member.

3. The golf training aid of claim 2, wherein the length of the aiming rod between the first and second ends is adjustable to a length of between about 8 inches and 30 inches.

4. The golf training aid of claim 1, wherein the U-shaped member has a ball-and-socket joint extending therefrom, the ball-and-socket joint pivotally coupling the aiming rod to the U-shaped member.

5. The golf training aid of claim 4, wherein the aiming rod is pivotable with respect to the U-shaped member between a proximate position and a distant position for pointing the second end of the aiming rod to a preferred ball position relative to the shoe of the golfer, wherein the aiming rod is positioned substantially parallel an adjacent straight portion of the U-shaped member when in the proximate position, the aiming rod being positioned at an angle from the adjacent straight portion of the U-shaped member when in the distant position.

6. The golf training aid of claim 5, wherein the first end of the aiming rod has a pivot pin slidably coupled thereto, the pivot pin being abuttable against the U-shaped member, the pivot pin being for permitting repeated positioning of the aiming rod at a predetermined position between the proximate and distant positions.

7. The golf training aid of claim 6, wherein an end of the pivot pin abutting the U-shaped member is rounded for permitting easier sliding of the pivot pin along the U-shaped member as the aiming rod moves between the proximate and distant positions.

8. The golf training aid of claim 4, wherein the aiming rod is pivotable with respect to the U-shaped member between a lowered position and a raised position for permitting normal walking by a person wearing the golfer's shoe, the aiming rod being positioned substantially in a plane defined by the U-shaped member when in the lowered position, the aiming rod being positioned substantially perpendicular to the plane defined by the U-shaped member and adjacent a lower leg of a golfer when in the raised position.

9. A golf training aid for teaching an individual correct ball positioning when in a golfer's stance comprising, in combination:

a pliable U-shaped member dimensioned for securement to a heel of a golfer's shoe, the U-shaped member having a ball-and-socket joint extending therefrom;

an elongate aiming rod having opposite first and second ends and a longitudinal axis extending between the ends, the ball-and-socket joint pivotally coupling the aiming rod to the U-shaped member;

the aiming rod including an outer member and an inner telescoping member, the inner telescoping member being slidably disposed within the outer member, wherein the length of the aiming rod between the first and second ends is adjustable to a length of between about 8 inches and 30 inches;

the aiming rod being pivotable with respect to the U-shaped member between a proximate position and a distant position for pointing the second end of the aiming rod to a preferred ball position relative to the shoe of the golfer, wherein the aiming rod is positioned substantially parallel an adjacent straight portion of the U-shaped member when in the proximate position, the aiming rod being positioned at an angle from the adjacent straight portion of the U-shaped member when in the distant position;

the first end of the aiming rod having a pivot pin slidably coupled thereto, the pivot pin being abuttable against the U-shaped member, the pivot pin being for permitting repeated positioning of the aiming rod at a predetermined position between the proximate and distant positions;

wherein an end of the pivot pin abutting the U-shaped member is rounded for permitting easier sliding of the pivot pin along the U-shaped member as the aiming rod moves between the proximate and distant positions; and the aiming rod being pivotable with respect to the U-shaped member between a lowered position and a raised position for permitting normal walking by a person wearing the golfer's shoe, the aiming rod being positioned substantially in a plane defined by the U-shaped member when in the lowered position, the aiming rod being positioned substantially perpendicular to the plane defined by the U-shaped member and adjacent a lower leg of a golfer when in the raised position.

* * * * *